US009279215B2

(12) United States Patent
Daoud et al.

(10) Patent No.: US 9,279,215 B2
(45) Date of Patent: Mar. 8, 2016

(54) FORMULATION COATED SELF-CLEANING WOOL

(75) Inventors: Walid Abdelhamid Daoud, Traralgon (AU); Sze Kar Leung, Hongkong (CH); Wing Sze Tung, Churchill (AU); Hao Zhong John Xin, Hong Kong (CH); Ka Leung Kevin Cheuk, Hong Kong (CH); Xiaowen Wang, Hong Kong (CN); Yee Yee Kong, Hong Kong (CH); Kaihong Qi, Hong Kong (CH)

(73) Assignees: The Hong Kong Polytechnic University, Kowloon, Hong Kong (CN), partial interest; Australian Wool Innovation Limited, Sydney, New South Wales (AU), partial interest ( * ) Notice: Subject to any disclaimer, the term of this patent is extended or adjusted under 35 U.S.C. 154(b) by 0 days.

(21) Appl. No.: 13/270,404

(22) Filed: Oct. 11, 2011

(65) Prior Publication Data

US 2012/0199759 A1 Aug. 9, 2012

Related U.S. Application Data

(62) Division of application No. 11/730,405, filed on Apr. 2, 2007, now Pat. No. 8,679,588.

(51) Int. Cl.

| | |
|---|---|
| ***D06M 11/46*** | (2006.01) |
| ***D06M 23/00*** | (2006.01) |
| ***D06M 11/07*** | (2006.01) |
| ***D06M 11/11*** | (2006.01) |
| ***D06M 11/20*** | (2006.01) |
| ***D06M 11/30*** | (2006.01) |
| ***D06M 11/38*** | (2006.01) |
| ***D06M 11/44*** | (2006.01) |
| ***D06M 11/55*** | (2006.01) |
| ***D06M 11/60*** | (2006.01) |
| ***D06M 11/61*** | (2006.01) |
| ***D06M 11/64*** | (2006.01) |
| ***D06M 13/144*** | (2006.01) |
| ***D06M 13/184*** | (2006.01) |
| ***D06M 13/192*** | (2006.01) |
| ***D06M 13/325*** | (2006.01) |
| ***D06M 13/342*** | (2006.01) |
| ***D06M 13/355*** | (2006.01) |

(52) U.S. Cl.

CPC ..... *D06M 23/00* (2013.01); *D06M 11/07* (2013.01); *D06M 11/11* (2013.01); *D06M 11/20* (2013.01); *D06M 11/30* (2013.01); *D06M 11/38* (2013.01); *D06M 11/44* (2013.01); *D06M 11/55* (2013.01); *D06M 11/60* (2013.01); *D06M 11/61* (2013.01); *D06M 11/64* (2013.01); *D06M 13/144* (2013.01); *D06M 13/184* (2013.01); *D06M 13/192* (2013.01); *D06M 13/325* (2013.01); *D06M 13/342* (2013.01); *D06M 13/355* (2013.01); *D06M 2200/05* (2013.01); *Y10T 428/2915* (2015.01); *Y10T 428/2933* (2015.01); *Y10T 442/2762* (2015.04)

(58) Field of Classification Search

USPC ..... 8/115.51, 115.6, 128.1, 115.52, 115.53; 424/102, 113, 190, 361, 365

See application file for complete search history.

(56) References Cited

U.S. PATENT DOCUMENTS

| | | | | |
|---|---|---|---|---|
| 2,075,967 | A | 4/1937 | Vittengl | |
| 2,122,793 | A | 7/1938 | Dreyfus et al. | |
| 2,576,927 | A | 10/1947 | Dungler | |
| 2,629,723 | A | 2/1953 | Lundgren et al. | |
| 3,383,162 | A * | 5/1968 | Whitfield et al. | 8/128.1 |
| 3,837,850 | A | 9/1974 | Miyatuka | |
| 3,857,727 | A * | 12/1974 | Benisek | 427/430.1 |
| 4,076,633 | A | 2/1978 | Edwards et al. | |
| 5,854,169 | A | 12/1998 | Heller et al. | |
| 6,576,589 | B1 | 6/2003 | Han et al. | |
| 6,627,336 | B1 | 9/2003 | Ohmori et al. | |
| 2005/0204477 | A1 * | 9/2005 | Casella et al. | 8/115.51 |
| 2005/0260455 | A1 | 11/2005 | Xin et al. | |
| 2007/0238827 | A1 * | 10/2007 | Brady et al. | 524/556 |

FOREIGN PATENT DOCUMENTS

JP 2002138366 A 5/2002

OTHER PUBLICATIONS

FAQ: Photosensitive Aug. 14, 2012.*

Titanium-Oxide Photocatalyst, Three Bond Technical News, Jan. 1, 2004.

* cited by examiner

*Primary Examiner* — Amina Khan

(74) *Attorney, Agent, or Firm* — Boyle Fredrickson, S.C.

(57) ABSTRACT

The present invention relates to methods of making articles, and systems for providing wool articles having self-cleaning properties. The self-cleaning properties are brought about coating the wool articles with a photocatalyst formulation. The formulation contains titanium compounds, stabilizers, catalysts, and water.

10 Claims, 8 Drawing Sheets

| | | Tensile Strength | | | Tensile Extensibility | | |
|---|---|---|---|---|---|---|---|
| | | Untreated Fabric | Selfcleaning Fabric | Change% | Untreated Fabric | Selfcleaning Fabric | Change% |
| White Fabric | Warp (a) | 282.233 | 293.333 | +4.2% | 49.307 | 58.453 | +18.6% |
| | Weft (b) | 132.300 | 154.833 | +16.4% | 30.511 | 45.107 | +47.8% |
| | Total (c) | 414.533 | 447.966 | +8.1% | 39.909 | 51.780 | +29.8% |
| Beige Fabric | Warp (d) | 174.667 | 183.300 | +4.9% | 40.364 | 52.293 | +29.6% |
| | Weft (e) | 118.333 | 133.933 | +13.2% | 28.649 | 45.693 | +59.5% |
| | Total (f) | 293.000 | 317.233 | +8.3% | 34.507 | 48.993 | +42.0% |

FIG. 5

| | Shirley(ml/cm$^2$.s) (a) | | | KES-F(PKa.s/m) (b) | | |
|---|---|---|---|---|---|---|
| | Untreated Fabric | Selfcleaning Fabric | Change in Permeability | Untreated Fabric | Selfcleaning Fabric | Change in Resistance |
| White Fabric | 15.2 | 19.98 | +31.3% | 0.664 | 0.589 | -11.3% |
| Beige Fabric | 6.75 | 8.50 | +25.9% | 1.435 | 1.2263 | -14.5% |

FIG. 6

FORMULATION COATED SELF-CLEANING WOOL

BACKGROUND

Stain resistant finishes for wool products, such as wool carpets, have been available since 1987. Owing to intensive marketing campaigns in the USA, consumer response was rapid and by 1989 stainblocked carpets accounted for more than 50% of U.S. domestic wool containing carpet sales. The finishes used in stainblocking are mainly condensates of formaldehyde, furfuraldehyde or benzaldehyde, with phenol sulphonic acids, napthol sulphonic acids or dihydroxydiphenyl-sulphae sulphonates.

The stain-resist polymers are believed to form a layer close to the surface of the wool fiber exposing an anionic shield on the outer surface. This serves to repel other anionic species such as the acid dyes used as artificial coloring in food, for example the dyes FD&C40 and amaranth. However, such stain-resist treatments have less effect against non-ionic organic contaminants and hot beverages such as coffee and other non-ionic organic contaminants. Two particularly different common stains are coffee and red wine. These are often said to be the main staining problem in Europe. Clearly, methods and products are needed to address organic contaminants on wool articles.

Heterogeneous photocatalysis have shown promise as a chemical method for oxidizing and thereby removing unwanted organic compounds from fluids, including water, and air. A UV-illuminated catalyst, such as titanium dioxide, absorbs UV light, which produces electrons and holes that migrate to the surface of the catalyst. At the surface, the electrons reduce adsorbed oxygen, while the holes oxidize organic compounds or adsorbed water molecules.

For example, titanium dioxide is a semi-conductor with a band gap of 3.0 ev (rutile) and 3.2 ev (anatase). When a photon having an energy in excess of the band gap is absorbed by the photocatalyst, an electron is promoted from the valence band to the conduction band. The promotion of the electrons produces a "hole". The hole and the electron may diffuse to the surface of the photocatalyst where each may chemically react. Surface electrons generally reduce adsorbed oxygen, while surface holes generally oxidize organic compounds or absorbed water molecules. When electrons vacancies (holes) react with water reactive OH radicals and protons are formed.

While the use of photocatalysis for the removal of organic pollutants is generally known, a commercially feasible process for the use of such catalysts on wool products has not been developed.

It is an object of the present system to provide improvement, and overcome the disadvantages and problems of the prior art.

DESCRIPTION

The present invention proposes methods of making a formulation coated self-cleaning wool article, such formulation being a photocatalyst allowing the article to clean itself upon exposure to a light source.

The present invention also proposes a system for cleaning a wool article, such system including a light source and a wool article coated with a formulation. The formulation consists of a titanium compound-based mixture, to serve as a photocatalyst on the surface of the wool article. It is believed that when catalyzed, the formulation triggers a self-cleaning process on the wool article, thus removing the organic contaminant.

The present invention further proposes the application of a photocatalyst formulation onto a wool article. The application on the wool article leads to improvement in various characteristics, including tensile strength, tensile extensibility, air permeability, and durability.

These and other features, aspects, and advantages of the apparatus and methods of the present invention will become better understood from the following description, appended claims, and accompanying drawings where:

BRIEF DESCRIPTION OF THE DRAWINGS

FIG. 5 shows the effects of the formulation on wool fabric tensile strength and tensile extensibility.

FIG. 6 compares the air permeability between untreated fabric and formulation coated fabric.

The following description of certain exemplary embodiment(s) is merely exemplary in nature and is in no way intended to limit the invention, its application, or uses. Throughout this description, the term "organic contaminant" refers to a material produced by a living organism, such material containing carbon and hydrogen that either visually, invisibly, or characteristically soils an article, such as a wool article.

Figure 1:
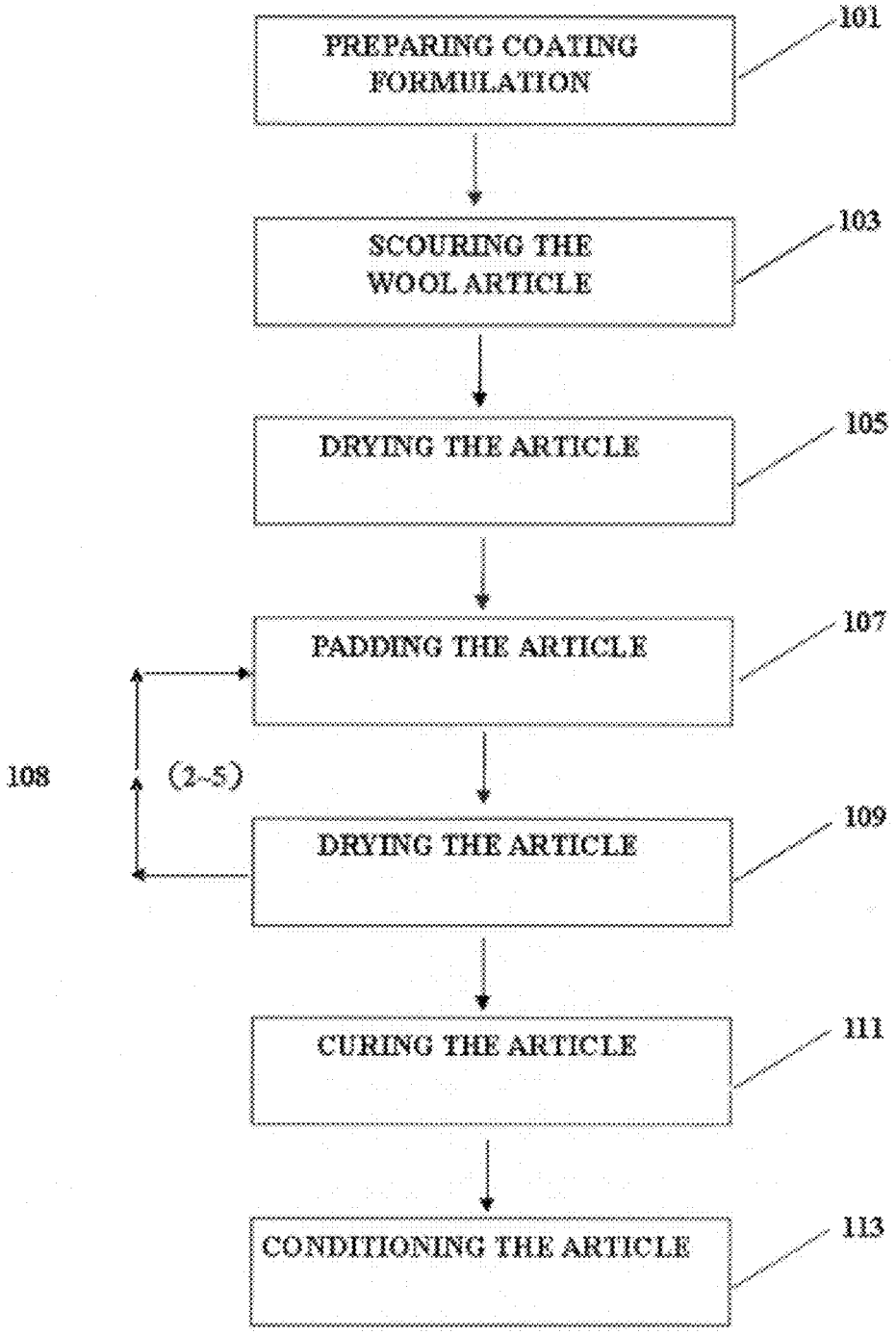
FIG. 1 shows an embodiment of making a formulation coated wool article of the present invention.

Now, to FIGS. 1-8,

FIG. 1 is an embodiment of making a formulation coated wool article of the instant invention, including the steps of preparing the formulation 101, scouring of the wool article 103, drying the article 105, padding the article 107, drying the article 109, curing the article 111, and conditioning the article 113. The resultant wool article is an article of the present invention, suitable for self-cleaning via a light source.

Preparing the formulation 101 pertains to creating the titanium compound-based formulation to be coated on the wool article. The formulation is used as a photocatalyst for the wool article. The formulation preferable contains titanium compound, catalyst and stabilizer, and water.

Suitable titanium compounds for use in the formulation includes but is limited to titanium tetraisopropoxide, titanium isopropoxide, titanium trichloride, titanium tetrachloride, titanium sulfate, titanium oxysulfate, titanium iron sulfate solution, titanium oxychloride, titanium ethoxide, titanium ethyloxide, titanium isobutoxide, titanium isoprophylate, titanium methoxide, and titanium nitrate. The titanium compounds may be used one, or two or more in combination. In an alternative embodiment, the titanium compound(s) are doped, for example, with nitrogen atoms. The titanium compounds can be in rutile-type structure or in anatase-type structure. The titanium compounds may also be a mixture of rutile-type and anatase-type, with the rate of rutile to anatase ranging from 0:100 to 25:75. Suitable titanium compounds can be excited as photocatalyst at an irradiance of between 0.1 $\mu W/cm^2$ and about 100 $mW/cm^2$. In one embodiment, the titanium compound is activated at between about 45 to about 95 mW/cm$^2$. The titanium compound can be included in the formulation is in amount of up to 30% v/v. In one embodiment, the titanium compound is used in an amount of about 10 to 15% v/v. The titanium compound is preferably nanosized, between about 5 to about 10 nm.

A catalyst and stabilizer are included in the formulation. The catalyst is used for efficient reaction of the various components of the formulation. Suitable catalysts include strong acids such as perchloric acid, hydroiodic acid, hydrobromic acid, hydrochloric acid, sulfuric acid, nitric acid; strong bases such as potassium hydroxide, barium hydroxide, cesium hydroxide, sodium hydroxide, strontium hydroxide, calcium hydroxide, lithium hydroxide, and rubidium hydroxide; weak bases such as alanine, ammonia, magnesium hydroxide, methylamine, and pyridine; moisture; and techniques such as aging the titanium compound between several hours and several days prior to its addition to the formulation. Concentration of the catalyst can be from about 30% to about 70%. The catalyst can be included in the formulation between about 0.5 to about 2% v/v. In one embodiment, the catalyst is selected from the group consisting of hydrochloric acid, nitric acid, or aging the titanium compound between several hours and several days.

The stabilizer is used to enhance the crystallization of the photocatalyst. Examples of suitable stabilizers include acetic acid and citric acid. The stabilizer can be included in an amount of from about 3 to about 7% v/v.

Water can be distilled, double distilled, ionized, or deionized. Water can be included in an amount of from about 60 to about 90% v/v.

In preparing the formulation 101, the water is charged with an activation mechanism, for example a mechanical stirrer. The catalyst and stabilizer are added in sequence to the water, i.e., first the stabilizer, then the catalyst. The aqueous solution is then stirred at approximately 300 to 500 rpm. The titanium compound is then added in a dropwise fashion into the aqueous solution. The mixture is heated to between about 35 to 58° C. Stirring is maintained between 15 to 20 hours.

Following preparing the formulation 101, the wool article, such wool article to be described in detail later, is scoured 103. Scouring 103 can occur by methods known in the art, such as rope washing, including conventional e.g. traditional, rapid, and with nozzles, or delicate action e.g. conveyer belt, drum, and combined with air, and combined scouring and mitting. Alternatively, open width scouring may be used, such as discontinuous e.g. traditional, with hammer, conveyor belt, and hydropuls, and continuous e.g. washing in series, continuous plant, vibro compart, and solvent. Scouring can incorporate the use of salts, such as potassium or sodium salts with pH about 10. Alkali compounds can also be used, including fatty alcohol ethoxylates. Liquor ratio during scouring can be from 1:20 to 1:100. In one embodiment, a liquor ratio of 1:50 is employed. Generally, the temperature can be from 35° C. to 50° C., however in one embodiment the temperature is gradually reduced during the process. In one embodiment, a temperature of 45° C. is employed. Further, reagents such as ammonia can be added. Scouring can occur for about 30 minutes. In one embodiment, scouring occurs without stirring agitation.

The wool article is then dried 105, such as by squeezing, hydroextracting, oven drying, and hydroexhaustion. Drying 105 can occur between about 10 to about 65° C.; machines for drying include a Charles-Whitely machine, Krantz machine, Hunter machine, spooner machine, or Dalglish multiples dryer. In one embodiment, drying 105 occurs in an oven at about 60° C. for about 10 minutes.

In one embodiment of the invention, a pre-treatment step may be applied to the fabric after drying. The pre-treatment step will involve the acylation of the fabric using succinic acid at between 60 to 67° C. for 0.5 to 2.5 hours. The fabric can then be washed with water. The wool article is then padded 107 with the formulation. Padding 107 can occur by conventional means in the art. Suitable instruments for providing padding include vertical padder, horizontal padder, vertical/horizontal padder, floor standing models, bench mounted models, padder with pneumatic pressure, variable speed padders, and padders with 2 to 3 rolls. In one embodiment, a horizontal padder is used. Prior to padding, the article is immersed in the formulation, such as by vat immersion. The article should be thoroughly wet prior to insert into the padder, the padder can be set to have a nip pressure at about 2.5 to 3 kg/cm$^2$, and a speed of about 7 to 8 rpm. In one embodiment, the nip pressure is 2.75 kg/cm$^2$ and the speed is 7.5 rpm. In general, one run of padding is accomplished.

Following padding 107, the article is dried 109. As in the previous drying step 105, drying can occur by conventional means. In one embodiment, drying occurs at about 60° C. for approximately 5 minutes.

Following drying 109, the article may be cured 111. However, in an alternative embodiment, the article may be retreated with the formulation 108, and then re-padded and dried. In this way, it is believed the article will become sufficiently coated with the formulation. Retreatment 108, followed by re-padding and drying can occur for between 2 to 5 times. In one embodiment, retreatment 108 followed by re-padding and drying occurs at least 2 times.

Following the final drying 109, curing 111 is performed on the article. Curing 111 can occur by well-known means in the art, including by curing machine. Curing 111 has its goal fixing the formulation on the article, thereby increasing fixation, as well as stabilization of the formulation. Curing 111 can occur from about 115° C. to about 120° C. for from 1 to about 3 minutes.

Conditioning can then be performed on the article, at between 15° C. to 30° C. Conditioning steps can include softening agents, cleaning, dry cleaning, fluffing, and the like.

Figure 2:
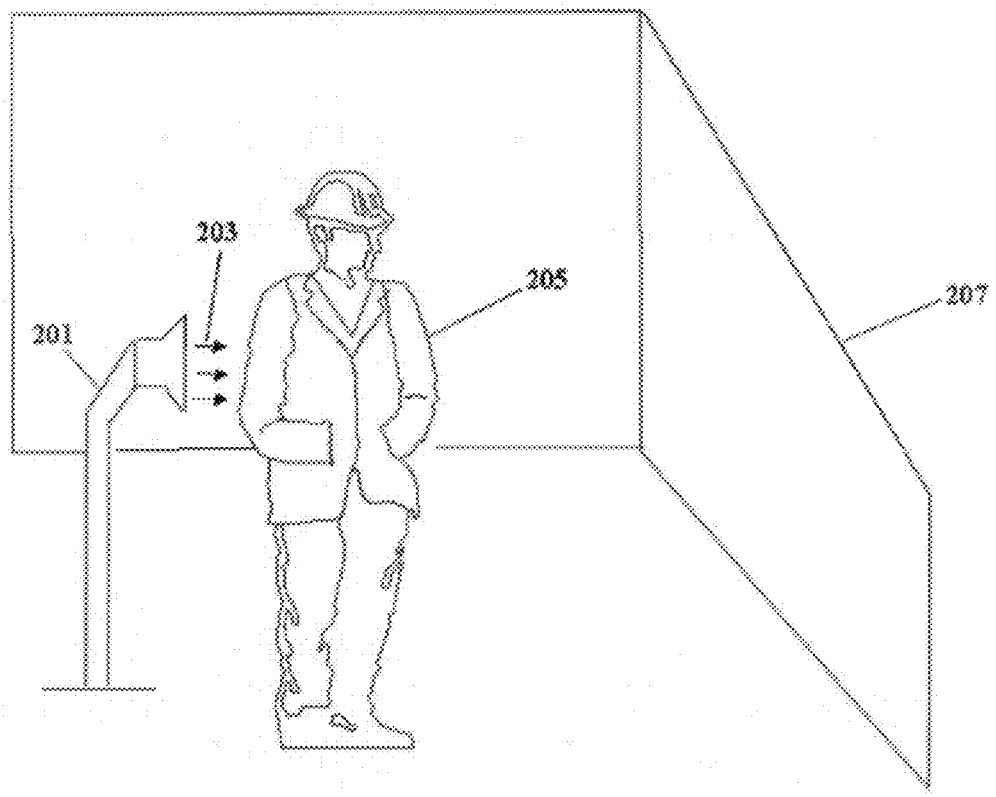
FIG. 2 shows an embodiment of the system of the present invention, including a light source, a formulation coated wool article, and an environment.

FIG. 2 is an embodiment of the system of the present invention, said system including a light source 201, and a wool article 205 made in accordance with the present invention, and an environment 207 for activating the coating on the wool article 205.

The light source 201 is capable of providing ultraviolet, near-ultraviolet, and visible light rays 203 that activate the photons of the formulation coating in the wool article 205. The light source 201 can provide rays 203 with wavelengths of 220-500 nm. Suitable light sources can include a solar source (e.g., the Sun), ultraviolet lights, halogen lights, indoor lighting, and the like. The rays 203 can exhibit intensities ranging from 0.1 μW/cm$^2$ to about 100 mW/cm$^2$. In one embodiment, the rays provide irradiance of 45 mW/cm$^2$ to 95 mW/cm$^2$. In the event the light source 203 is a solar source, the rays 203 can exhibit different irradiances depending on whether the ray 203 is direct from the solar source or filtered, such filter being, for example, through clouds, or glass. Table 1 is an example of intensities of the rays 203 from the solar source.

TABLE 1

| measurement location | | intensity of ultraviolet rays | remarks |
|---|---|---|---|
| outdoors | under direct sunlight | 4 to 5 mw/cm$^2$ | fair weather |
| | | 2 to 2.5 mw/cm$^2$ | slight overcast |
| | | 0.7 to 0.8 mw/cm$^2$ | cloudy |
| inside vehicle | through rear window glass | 150 to 350 μw/cm$^2$ | fair weather-slight overcast |
| | through side window glass | 90 to 300 μw/cm$^2$ | |
| | through front glass | 0.5 to 2.0 μw/cm$^2$ | |

TABLE 1-continued

| measurement location | | intensity of ultraviolet rays | remarks |
|---|---|---|---|
| | rear seat in shade | 10 to 30 μw/cm$^2$ | |
| | ceiling surface | 2 to 4 μw/cm$^3$ | |
| inside of house | immediately below the fluorescent lamp | 2 to 3 μw/cm$^2$ | |

The light source 201 can be a floor standing model, ceiling mounted, desk mounted, or, in the case of a solar source, be ethereal. The light source 201 can be one, or two or more light sources used in concert.

The wool article 205 possessing the formulation of the present invention is prepared in accordance with the present invention. The wool article 205 can be of worsted wool type, woolen wool type, or wool fiber product.

Worsted wool types include cashmere, mountain, longwood, clown, low crossbred, medium crossbred, fine crossbred, strong merino, average merino and fine merino. Articles made from such worsted wool types include fabrics, suits, pants, jackets, skirts, interior textiles, and the like.

Woolen wool types include yarn, cloth, blended yarns having wool and synthetic materials, such synthetics including nylon, polypropylene, polyester or sovona. Articles made from such woolen wool types are carpet, rugs, sweaters, automobile interior fabrics, furniture fabric, wall fabrics, curtains, and footwear.

Wool fiber product includes insulation made from wool fiber, sound barriers, and interior building materials.

The wool article 205 possesses the formulation of the present invention. The formulation, as stated earlier, is used as a photocatalyst for the cleaning of the wool article 205. The formulation contains titanium compounds, catalysts, stabilizers, and water. The wool article 205 also likely possesses organic contaminants which are in need of cleaning. Organic contaminants can include sweat, odors, blood, chocolate, coffee, red wine, fruit juice, grass, grease, ink, oil, sauce such as tomato sauce, and soda such as orange soda. The contaminants can include pigments that lead to visible indicators on the wool article 205. The pigments generally include condensates such as furans, pyrroles, pyridones, 1,4 guinones, furfurals, and anthocyanins. As an example of such pigments:

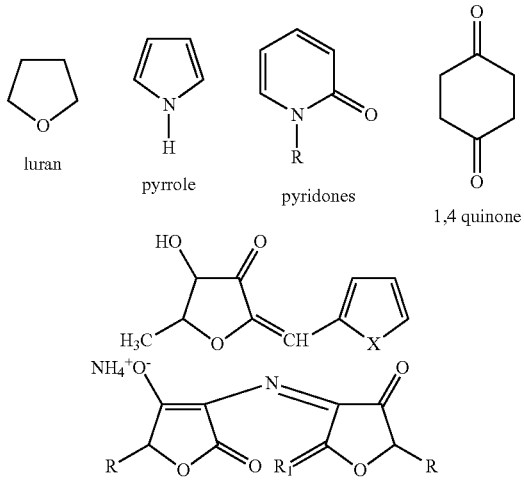

-continued

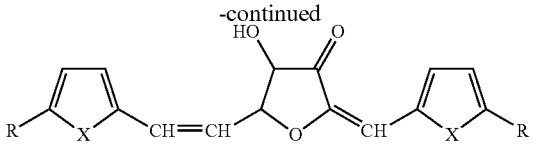

where R can be selected from the group consisting of H, $CH_2$, —CHOH, —$CHO_2OH$ and X can be selected from the group consisting of O, and $NCH_3$; and the anthocyanins of the formula:

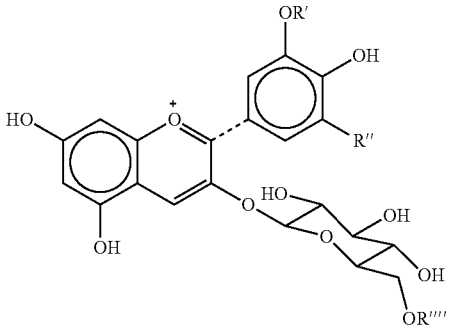

In use, the wool article 205 is positioned in front of the light source 201 such that it can be activated by the rays 203. The position can be directly in front of the source 201 or in the vicinity thereto. While not to be bound by theory, it is believed when the formulation coated on the article 205 is exposed to the rays 203, electrons and positive holes are formed in the formulation coating. The electrons and positive holes recombine, likely at a slow rate, producing hydroxyl radicals. Hydroxyl radicals, having strong oxidative power, are capable of reacting with the organic contaminants. The organic contaminants will then decompose, releasing carbon dioxide ($CO_2$) and water ($H_2O$). Exposure of the wool article 205 to the rays 203 can be from about 1 to about 20 hours. In one embodiment, exposure is for around 8 hours. Exposure can occur multiple times to ensure the organic contaminants have been sufficiently removed. In an alternative embodiment, the wool fabric 205 can firstly be exposed to the rays 203, and then cleaned using conventional methods such as dry cleaning or steam cleaning.

Exposure of the wool article 205 to the rays 203 can occur in a closed or open environment 207. Closed environments can include rooms, workrooms, laundry mats, home environment, closets, and the like. The closet environment can include reflection means, such as mirrors, to ensure the wool article 205 receives 360° exposure. Open environments can include being outside, for example, when the wool article 205 is exposed to a solar light source, such exposure can occur outside.

Examples

Several sample wool fabrics were made in accordance with the present invention, with the samples possessing the formulation coating. The formulation contained the following:

| | |
|---|---|
| 97% Titanium Tetraisopropoxide | 15% |
| 32% Hydrocholoric Acid | 1.6% |
| Acetic Acid | 5% |
| Water | 78.4% |

The formulation is prepared as previously mentioned. The samples were made by scouring the fabrics by soaking with a liquor ratio 1:50 at 45° C. for 30 minutes. The fabrics were dried at 60° C. for about 5 to about 10 minutes. The fabrics were then dipped into the formulation, and then padded using a horizontal padder at nip pressure of 2.75 kg/cm$^2$ and a speed of 7.5 rpm. The padded fabric was then dried at 60° C. for 5 minutes. The pad-dry procedures were repeated 2 times (applying two coatings). The fabrics were then cured at 120° C. for 3 minutes. The various fabrics made are white, grey, and beige in color.

Figure 3:
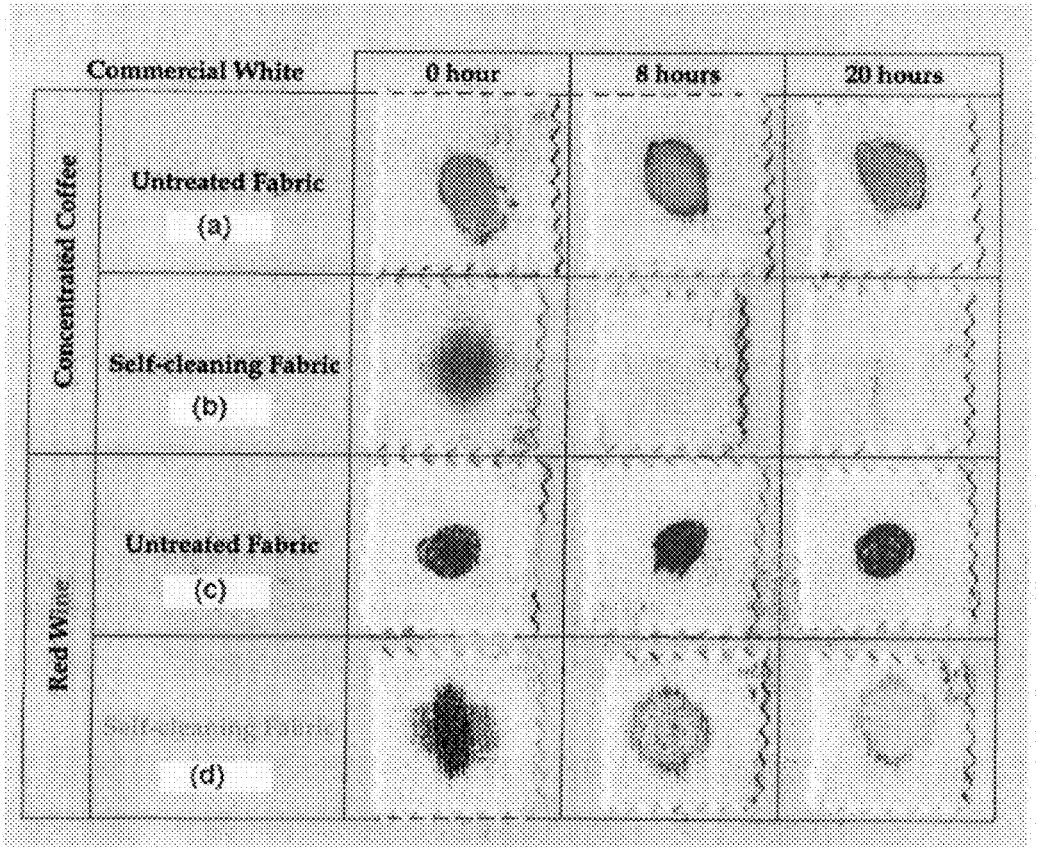
FIG. 3 shows pigment fading on a formulation coated wool article following light irradiation.

FIG. 3 shows significant discoloration of both coffee and red wine stains on a white worsted commercial fabric at 0 hours, 8 hours and 20 hours at light irradiation of between 45-95 mW/cm$^2$, comparing untreated fabrics and a formulation coated fabric of the instant invention.

FIG. 3(*a*) shows that for coffee stains, on an untreated white wool fabric, the pigment does not fade following application of rays. 3(*b*) shows that on the formulation coated fabric (i.e., self-cleaning), following application of rays, the pigment of the stain fades over time and by 20 hours, the pigment is unnoticeable. 3(*c*) shows that for red wine stains on the untreated white wool fabric, even after application of rays, the pigment does not fade. 3(*d*), in contrast, shows that red wine stain on the formulation coating fabric fades over time following application of rays.

Figure 4:
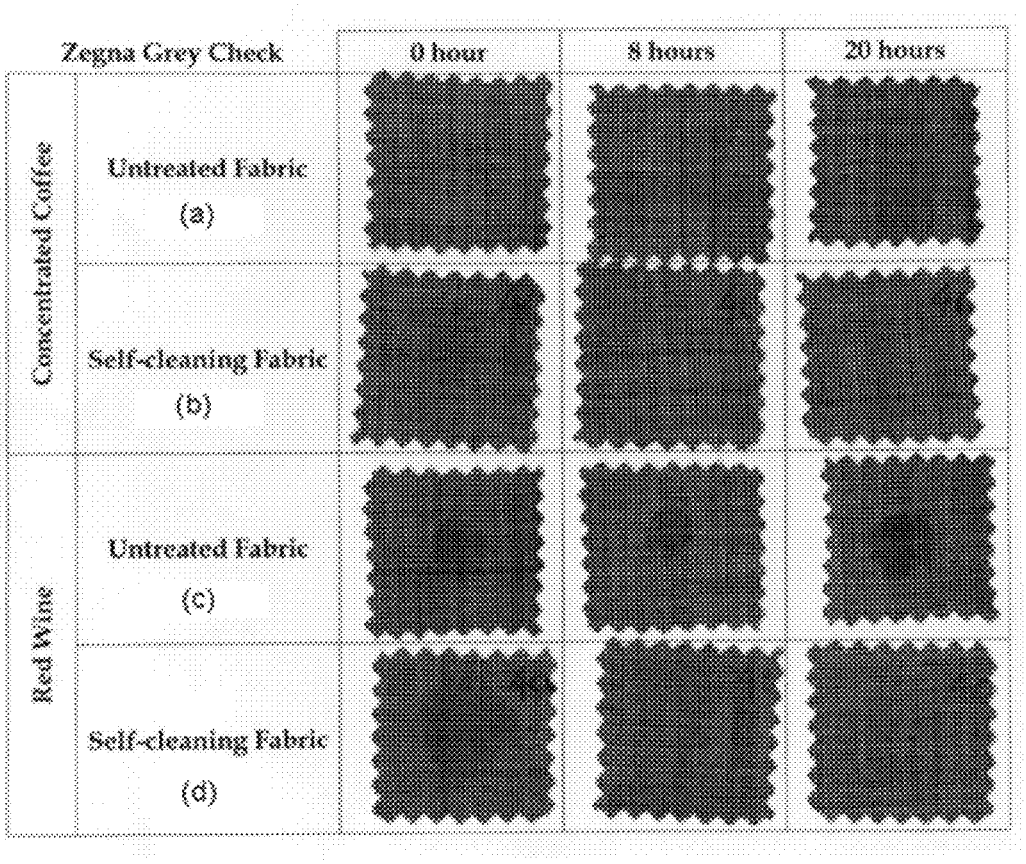
FIG. 4 shows the effects of photocatalyst formulation on a grey-colored fabric with stains.

FIG. 4 shows the treatment of coffee and red wine stains by application of rays, on both untreated fabric and formulation coated fabric, for a grey-colored wool fabric. Both 4(*a*) and 4(*b*) exhibits that coffee stains do not show up on the grey fabric. 4(*c*) and 4(*d*) show that when rays are applied to the grey fabric with pigment from red wine, the coated fabric allows the pigment to fade over time, effectively cleaning up within 20 hours. The untreated fabric exhibits no improvement in terms of fading of the pigment.

FIG. 5 shows the effect of the formulation coated fabric on the tensile strength and tensile extensibility of a white fabric and a beige fabric.

As shown in 5(*a*), the tensile strength of the warp, the set of lengthwise yarns through which the weft is woven, for the white fabric increases by 4.2%, and the tensile extensibility for wrap increases by 18.6%. 5(*b*) shows that the tensile strength of the weft increases by 16.4% and the tensile extensibility of weft increases by 47.8%. 5(*d*) shows that for the beige fabric the tensile strength of the warp increases by 4.9% and the tensile extensibility of the warp increases by 29.6%. 5(*e*) shows the tensile strength of weft increases by 13.2% and the tensile extensibility of weft increases by 59.5%.

FIG. 6 shows the comparison of air permeability between untreated fabric and formulation coated fabric. The air permeability test was used to assess the air breathability performance after self-cleaning treatment following standard test method ISO 9237; 1995 using Shirley Air Permeability Tester (SDL International Textile Testing Solutions P505254)(6*a*), and KES-F Air Permeability Tester KES-F8-AP1 (Kato Tech Co. Ltd.) (6(*b*)). The results from both tests as shown in the table demonstrate that the self-cleaning treatment enhances the air permeability of both commercial white and Ermenegildo Zegna™ beige fabrics.

Figure 7:
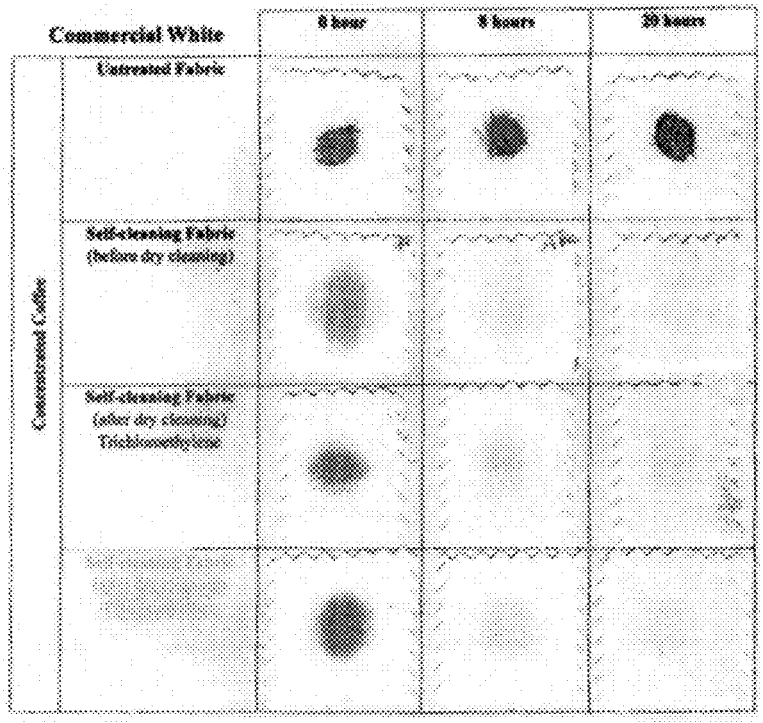
FIG. 7 shows the effect of dry-cleaning on the stability of the self-cleaning properties with regard to coffee stains.
Figure 8:
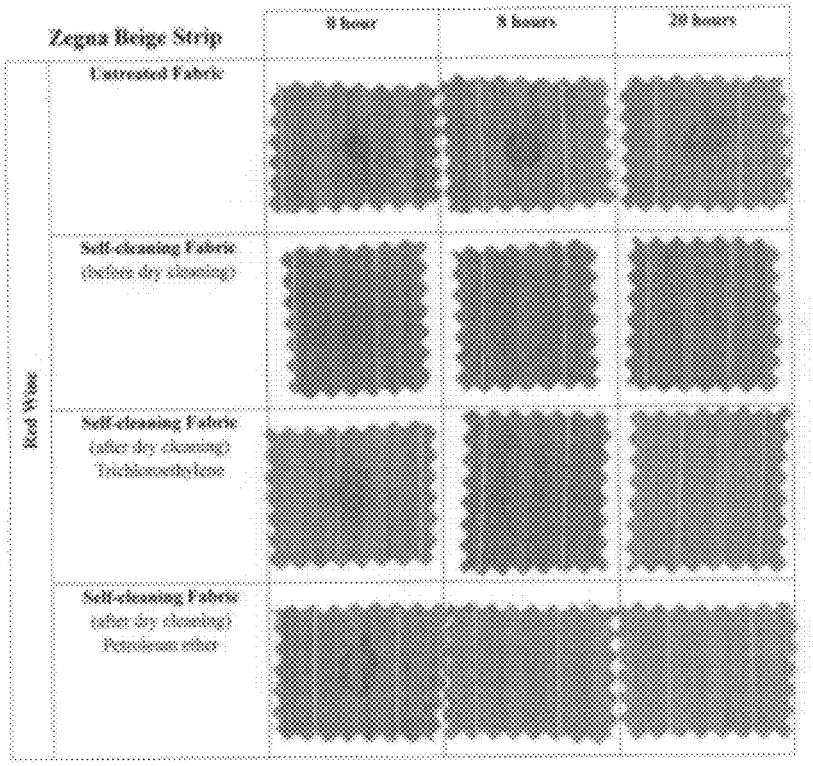
FIG. 8 shows the effect of dry cleaning on the stability of the self-cleaning properties with regard to red wine stains.

FIGS. 7 and 8 show the effect of dry-cleaning on the stability of the self-cleaning properties. The self-cleaning fabrics were subjected to a dry-cleaning procedure following standard test method BS/ISO LO5-DO1 using Ahiba Nuance Top Speed II (Applied Colour Systems, Inc. d/b/a Datacolor International) and tricholorethylene as solvent. The stain removal effectiveness of the self-cleaning fabric was compared before and after dry-cleaning. FIG. 7 and FIG. 8 show a significant discoloration of the coffee and red wine stains on the commercial white fabric after dry-cleaning as compared with untreated fabric.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. A formulation coated wool article, comprising a wool article; and a photocatalyst formulation containing a titanium compound in an amount of up to 30 v/v, wherein the titanium compound is selected from the group consisting of titanium tetraisopropoxide, titanium isopropoxide, titanium ethoxide, titanium isobutoxide, and titanium methoxide, one or more catalysts as a solution in a 30% up to 70% concentration in an amount of 0.5% to 2.0% v/v, wherein the catalyst is selected from perchloric acid, hydroiodic acid, hydrobromic acid, hydrochloric acid, and nitric acid for efficient reaction of the formulation, one or more stabilizers in an amount of 3% to 7% v/v, configured to enhance the crystallization of the one or more catalysts wherein the stabilizer is selected from acetic acid and citric acid, and water in an amount of 60% to 90% v/v.

2. The formulation coated wool article of claim 1, wherein said wool article is a worsted wool type, woolen wool type, or wool fiber.

3. The formulation coated wool article of claim 2, wherein said worsted type is selected from the group consisting of cashmere, mountain longwood, clown, low crossbred, medium crossbred, fire crossbred, strong merino, average merino, and fine merino.

4. The formulation of claim 2, wherein said woolen type is selected from the group consisting of yarn, cloth, and blended yarns having wool and synthetic materials.

5. The formulation coated wool article of claim 1, wherein said wool article further comprises stains.

6. A system for self-cleaning a formulation coated wool article, comprising a light source;

a wool article coated with a photocatalyst formulation, wherein said photocatalyst formulation comprises, a titanium compound in an amount of up to 30% v/v, wherein the titanium compound is selected from the group consisting of titanium tetraisopropoxide, titanium isopropoxide, titanium ethoxide, titanium isobutoxide, and titanium methoxide;

a catalyst as a solution in a 30% to 70% concentration in an amount of 0.5% to 2.0% v/v, wherein the catalyst is selected from perchloric acid, hydroiodic acid, hydrobromic acid, hydrochloric acid, sulfuric acid, and nitric acid;

a stabilizer in an amount of 3% to 7% v/v, wherein the stabilizer is selected from acetic acid and citric acid; and water in an amount of 60% to 90% v/v; and an environment.

7. The system of claim 6, wherein said light source is selected from the group consisting of the sun, ultraviolet light, halogen light, and indoor lighting.

8. The system of claim 6, wherein said light source provides rays with wavelengths of 220 to 500 nm.

9. The system of claim 6, wherein said light source provides rays exhibiting intensities of from 0.1 pW/cm2 to 100 mW/cm2.

10. The system of claim 9, wherein said light source exhibit irradiances of from 45 mW/cm2 to 95 mW/cm2.

* * * * *